US007351003B1

(12) United States Patent
Fenimore et al.

(10) Patent No.: US 7,351,003 B1
(45) Date of Patent: Apr. 1, 2008

(54) VEHICLE BARRIER ADVERTISEMENT SYSTEM

(75) Inventors: Scott Fenimore, St. Petersburg, FL (US); Matthew Stutsman, St. Petersburg, FL (US)

(73) Assignee: Bumpads, Inc., St. Petersburg, FL (US)

( * ) Notice: Subject to any disclaimer, the term of this patent is extended or adjusted under 35 U.S.C. 154(b) by 0 days.

(21) Appl. No.: 11/684,657

(22) Filed: Mar. 12, 2007

(51) Int. Cl.
*E01C 11/22* (2006.01)

(52) U.S. Cl. ..... 404/7; 40/565

(58) Field of Classification Search ..... 404/7; 40/565

See application file for complete search history.

(56) References Cited

U.S. PATENT DOCUMENTS 1,065,231 A * 6/1913 Finger ..... 40/612
1,272,177 A * 7/1918 Almquist et al. ..... 40/565
1,648,459 A * 11/1927 Mendoza ..... 40/565
2,503,574 A * 4/1950 Allen ..... 40/565
2,920,184 A * 1/1960 Kessler ..... 362/152
3,663,808 A * 5/1972 Baatz ..... 362/152
D351,422 S * 10/1994 Morris ..... D20/10
D393,320 S * 4/1998 Sinclair ..... D25/102
5,772,357 A * 6/1998 Evans ..... 404/7
D418,167 S 12/1999 Stutsman
6,393,748 B1 * 5/2002 Cooper ..... 40/610
6,481,921 B1 11/2002 Fenimore et al.
6,692,182 B1 2/2004 Fenimore et al.

* cited by examiner

*Primary Examiner*—Gary S. Hartmann
(74) *Attorney, Agent, or Firm*—Dennis G. LaPointe

(57) ABSTRACT

A vehicle barrier advertisement system comprising a vehicle parking barrier having a lower face member, a spaced-apart top face member, with a vertical portion extending from the lower face and angularly oriented spaced-apart grooves for insertion of one or more advertisement indicia sheets, and removable end caps. Illumination of the advertisement sheet is also provided using an AC or DC power source.

12 Claims, 14 Drawing Sheets

VEHICLE BARRIER ADVERTISEMENT SYSTEM

FIELD OF THE INVENTION

The present invention relates to a vehicle barrier advertisement system and more particularly pertains to insuring proper vehicle positioning in a parking lot while providing suggestive advertisement to be noticed by drivers parking in the location where the unique barrier is located.

BACKGROUND OF THE INVENTION

The use of vehicle barriers and advertisements of known designs and configurations is known in the prior art. More specifically, vehicle barriers and advertisements of known designs and configurations previously devised and utilized for the purpose of advertising by conventional methods and apparatuses are known to consist basically of familiar, expected, and obvious structural configurations, notwithstanding the myriad of designs encompassed by the crowded prior art which has been developed for the fulfillment of countless objectives and requirements.

In this respect, novel changes and improvements were provided in U.S. Pat. Nos. 6,692,182 and 6,481,921, both to Fenimore et al. as well as in U.S. Design Pat. No. D418,167 to Stutsman. These barrier advertisement systems substantially departed from the conventional concepts and designs of the prior art, and in doing so provide an apparatus primarily developed for the purpose of insuring proper vehicle positioning in a parking lot while providing advertisement.

In an effort to provide a system that is even more efficient to produce and more durable in cold weather conditions, the present invention provides additional novel features that will provide more flexibility to property owners and advertisers and will also facilitate easier maintenance and repair of the devices installed. In this regard, the present invention substantially fulfills this need.

SUMMARY OF THE INVENTION

In view of the foregoing disadvantages inherent in the known types of vehicle barriers and advertisements of known designs and configurations now present in the prior art, the present invention provides an improved vehicle barrier advertisement system. This system not only serves as a wheel stop or bumper for the wheel of the car, but more importantly, provides a visual advertisement medium to advertise products, commodities and/or services.

As such, the general purpose of the present invention, which will be described subsequently in greater detail, is to provide a new and improved vehicle barrier advertisement system, which has all the advantages of the prior art and none of the disadvantages.

To attain this, the present invention comprises a vehicle barrier comprising a generally horizontal planar lower face member and a spaced-apart top portion at a predetermined height from said horizontal planar lower face member, at least one side of the vehicle barrier further comprising a vertical portion extending from a distal end of said horizontal planar lower face member a predetermined height, said top portion having a width dimension less than that of said planar lower face such that a side of said top portion is in an angularly aligned relationship to that of said predetermined height of the vertical portion, and a pair of opposed grooves extending substantially along the length of the vehicle barrier side, one of the grooves being located near the vertical portion extended height and the opposed groove being located near an edge of the top portion, wherein the opposing grooves serve as means for receiving an advertisement indicia sheet.

The opposing grooves are aligned so that when said advertising indicia sheet in installed, the sheet is oriented at an angularly aligned relationship to that of the top (predetermined extended height) of the vertical portion so that the sheet generally faces upward for ease of reading the advertisement indicia on the sheet.

An inwardly directed L-shaped portion forms a cavity that underlies the advertisement indicia sheet when the advertisement indicia sheet is installed. The inwardly directed L-shaped portion forming the cavity (when the advertising sheet is installed) extends a length of the vehicle barrier side. A vertical leg of the L-shaped portion ends near the top portion of the vehicle barrier and a horizontal leg of the L-shaped portion commences near a top of the vertical portion.

The horizontal lower face member further comprises a plurality of spaced-apart apertures. The spaced-apart apertures are aligned with a corresponding plurality of spaced-apart apertures in the horizontal leg of said L-shaped portion, where both of the plurality of spaced-apart apertures serve as means for inserting desired fasteners, such as anchor bars or rebar, to hold the system in place when installed for use.

The system further comprises a pair of end caps at each end of said system.

The system further comprises a structural support member extending from near a bottom of the vertical leg of said L-shaped portion downwardly to said horizontal planar lower face member.

As far as the inside structure is concerned, the walls and angles of the walls are critical for the support necessary to bear the weight of a vehicle that would stop on the bumper.

The system further comprises means for securing said end caps to the system. The means for securing the end caps to the system comprises an aperture in each of the end caps through which a fastener is inserted for mechanical engagement with a corresponding fastener mating portion near each end of said system. Typically, this mechanical engagement can be done using a threaded engagement.

The barrier typically has a height of about 4 inches and a length of about 36 inches (91.4 cm) to about 84 inches (213.4 cm) and can be manufactured in various heights and/or lengths.

The barrier portion of the system can be made from a variety of materials, preferably from a durable material comprising one of the following examples of materials: 6063T5 aluminum alloy material, 6061T6 aluminum alloy material, polycarbonate material, acrylonitrile butadiene styrene (ABS) material, polypropylene material, acetal material or nylon material.

Similarly, the end caps can be made from a variety of materials, preferably from a durable material comprising one of the following examples of materials: 5052T5 aluminum alloy material, 6061T6 aluminum alloy material, 7073T6 aluminum alloy material, steel material, iron material, polycarbonate material, acrylonitrile butadiene styrene (ABS) material, polypropylene material, acetal material or nylon material.

The pair of opposed grooves are sized so as to receive two or more advertisement indicia sheets. In situations where only one sheet is desired, a spacer sheet may be inserted so as to underlie the advertising sheet. This will allow the advertising sheet to fit relatively snug within the grooves. The spacer sheet is preferably made from a clear or white plastic material (such as polystyrene) so as to allow illumination means as discussed below to be incorporated in the invention.

The advertisement sheet material can vary depending on application. Its material composition can be of metal(s), plastic(s), film(s) or paper(s). In addition the sheet thickness can vary from about 0.005 inches (0.012 cm) thick to about 0.188 inches (0.476 cm) thick, again depending on the material used and its application. These materials will be primarily used for non-illuminated/reflective "Advertisements".

The invention further comprises means for illuminating the advertisement indicia sheet and/or the advertisement indicia presented on the advertisement sheet. For illuminated advertisement sheets, the main source of illumination and or animation is preferably at this time the use of Electroluminescence (EL) technology. This technology produces light through luminescence instead of incandescence and requires a low amount of energy and does not produce significant heat.

It is also contemplated as within the scope of this invention that as new technologies develop, such lighting technology would, if appropriate, be incorporated in a wheel stop system as herein presented.

Examples of EL would be Light Emitting Diodes (LED's) and EL "Paper" which is coated with a phosphor material. The LED's will be used in edge light applications and will be limited to illuminate the advertisement. With the EL Paper, we cannot only effectively illuminate the advertisement but animate it as well. This can be accomplished through printed phosphor circuit(s) and a circuit controller that would supply electricity to each circuit in a predetermined order which in turn creates the animation. To get a better understanding of available commercial technology in this illumination field, one source of such products are those made by W & Co. Design Solutions, Ltd., Seven Oaks Kent, United Kingdom. Both of these forms of lighting are very durable and energy efficient and have the best immediate potential. Additionally, other methods of lighting the "Advertisement" have been researched such as "neon." However, considering the environment and use of the product, it is believed that LED and EL types of lighting are the preferred alternatives at this time.

There has thus been outlined, rather broadly, the more important features of the invention in order that the detailed description thereof that follows may be better understood and in order that the present contribution to the art may be better appreciated. There are, of course, additional features of the invention that will be described hereinafter and which will form the subject matter of the claims attached.

In this respect, before explaining at least one embodiment of the invention in detail, it is to be understood that the invention is not limited in its application to the details of construction and to the arrangements of the components set forth in the following description or illustrated in the drawings.

The invention is capable of other embodiments and of being practiced and carried out in various ways. Also, it is to be understood that the phraseology and terminology employed herein are for the purpose of descriptions and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

It is therefore an object of the present invention to provide a new and improved combination vehicle barrier and advertisement system which has all of the advantages of the prior art vehicle barriers and advertisements of known designs and configurations and none of the disadvantages.

It is another object of the present invention to provide a new and improved vehicle barrier and advertisement system which may be easily and efficiently manufactured and marketed.

It is further object of the present invention to provide a new and improved vehicle barrier and advertisement system which is of durable and reliable construction.

An even further object of the present invention is to provide a new and improved vehicle barrier and advertisement system which is susceptible of a low cost of manufacture with regard to both materials and labor, and which accordingly is then susceptible of low prices of sale to the public, thereby making such vehicle barrier/advertisement system economically available to the public.

Even still another object of the present invention is to provide a vehicle barrier and advertisement system for insuring proper vehicle positioning in a parking lot while providing advertisement.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there are illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DETAILED DESCRIPTION OF THE INVENTION

Figure 1A:
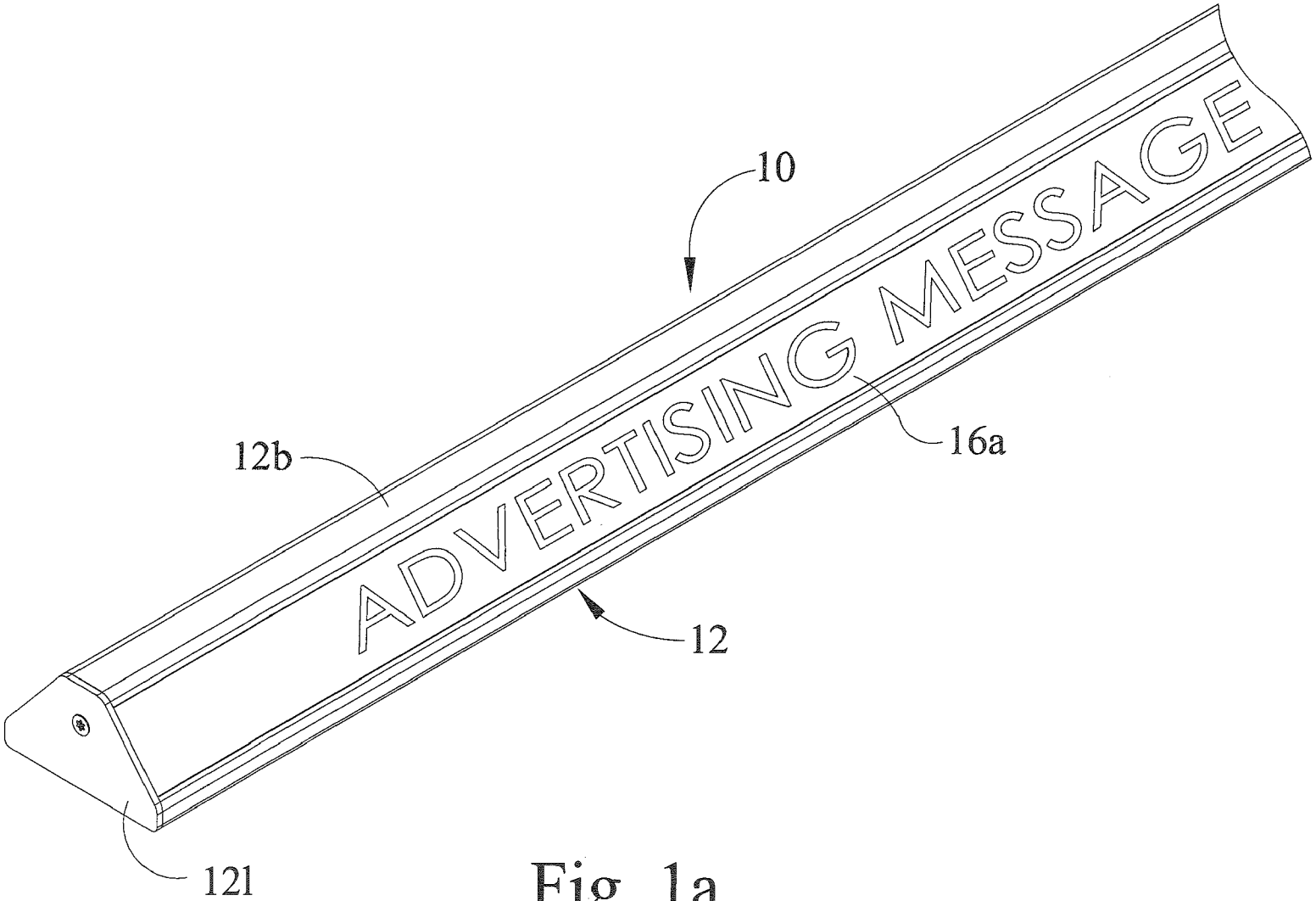
FIG. 1*a* is a perspective illustration of a partial view of the vehicle barrier advertisement system constructed and displayable in accordance with the principles of the present invention.
Figure 1B:
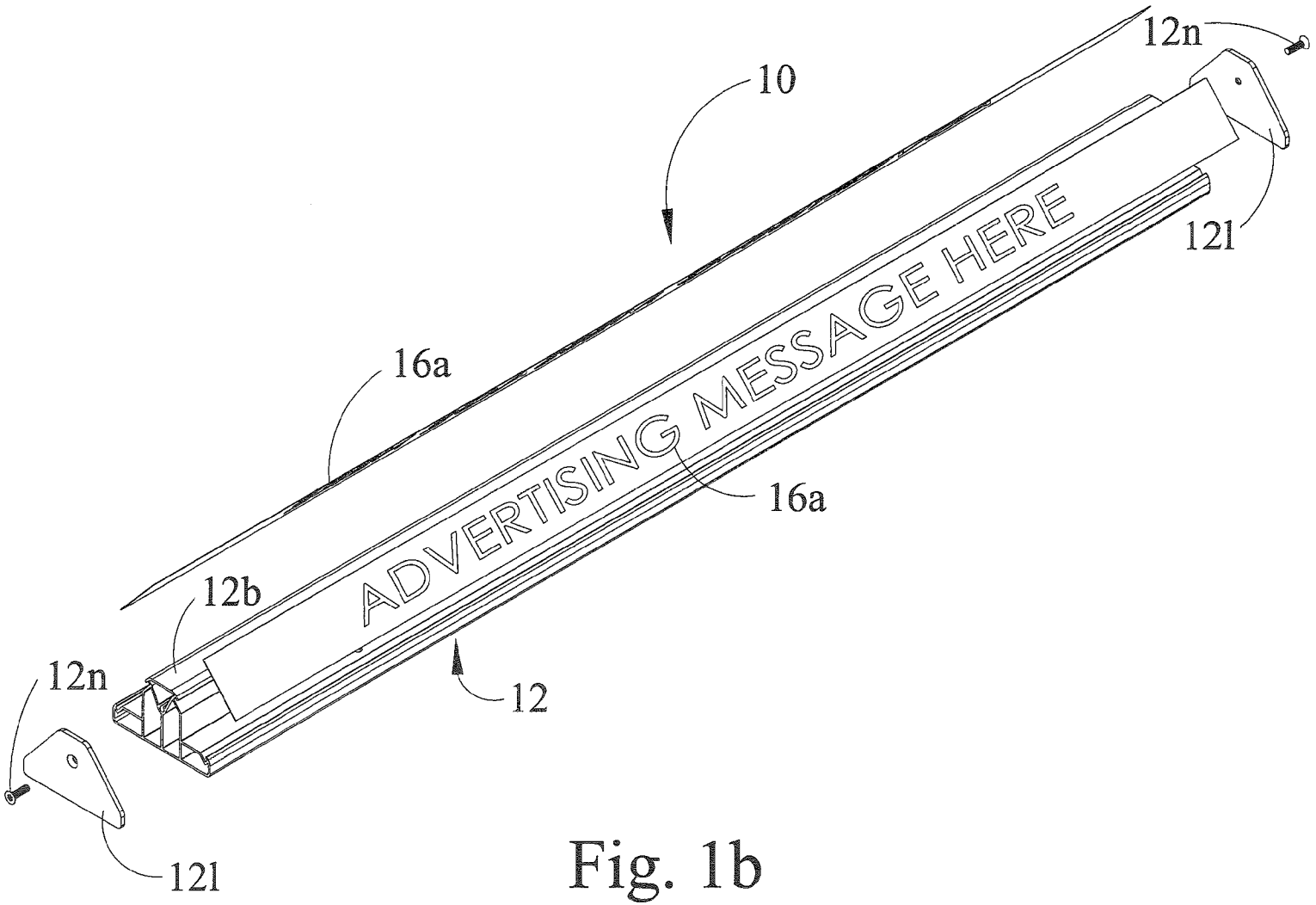
FIG. 1*b* is an exploded view of the invention depicted in FIG. 1.
Figure 2:
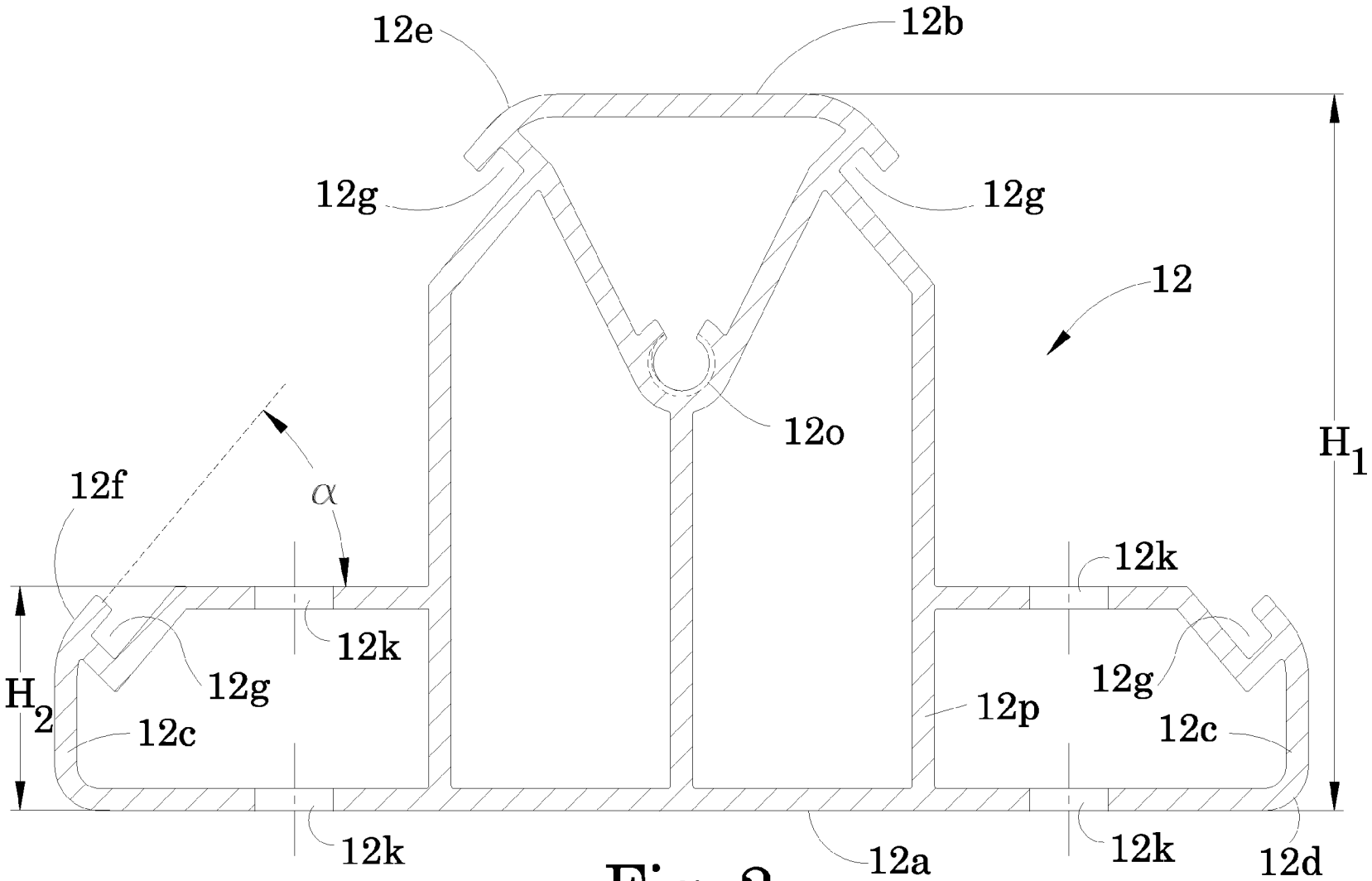
FIG. 2 is a cross-sectional depiction of the invention of FIG. 1.
Figure 3A:
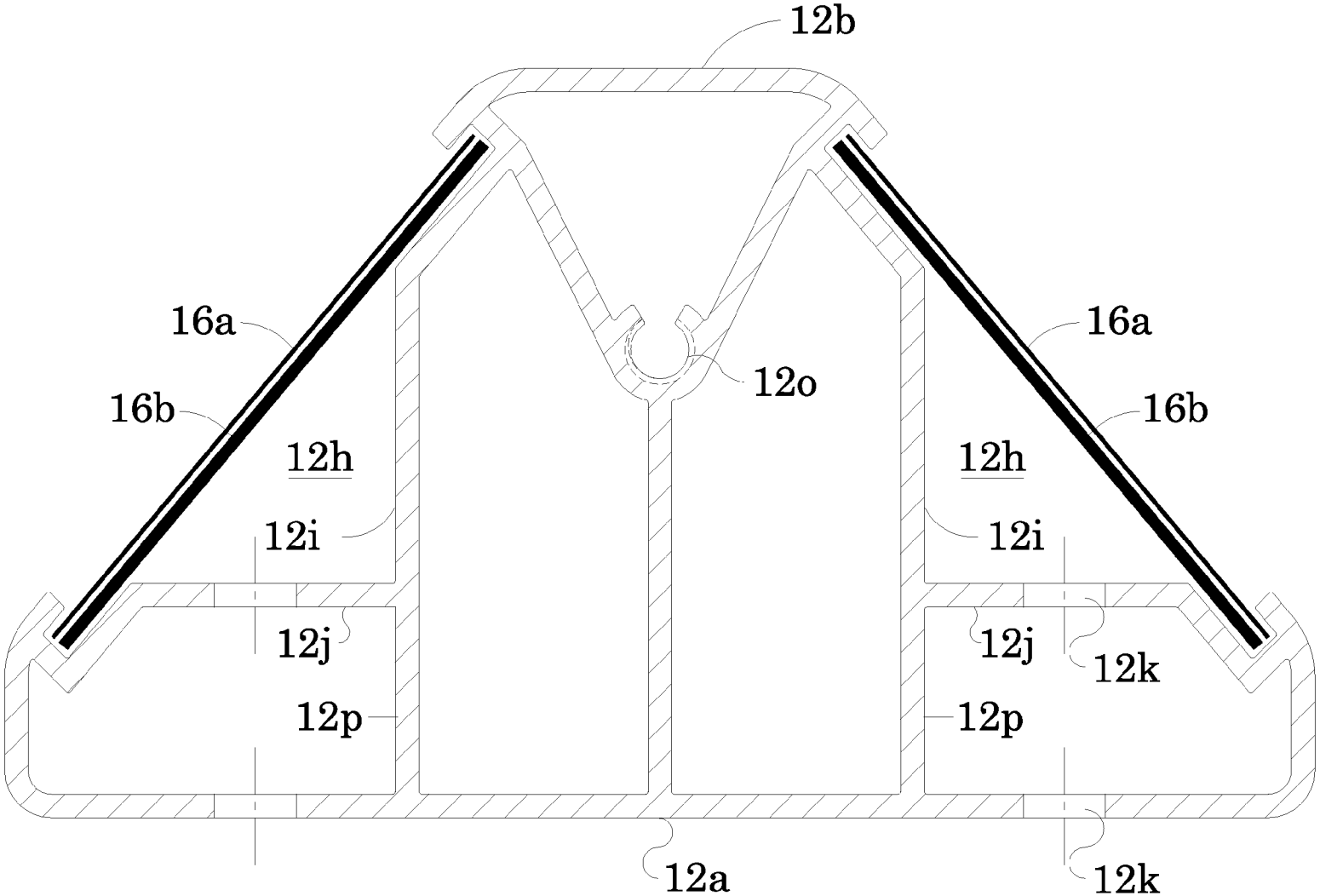
FIG. 3*a* is a cross-sectional depiction of the invention of FIG. 1, further depicting an advertisement sheet and an underlying spacer sheet installed on both sides of the barrier.
Figure 3B:
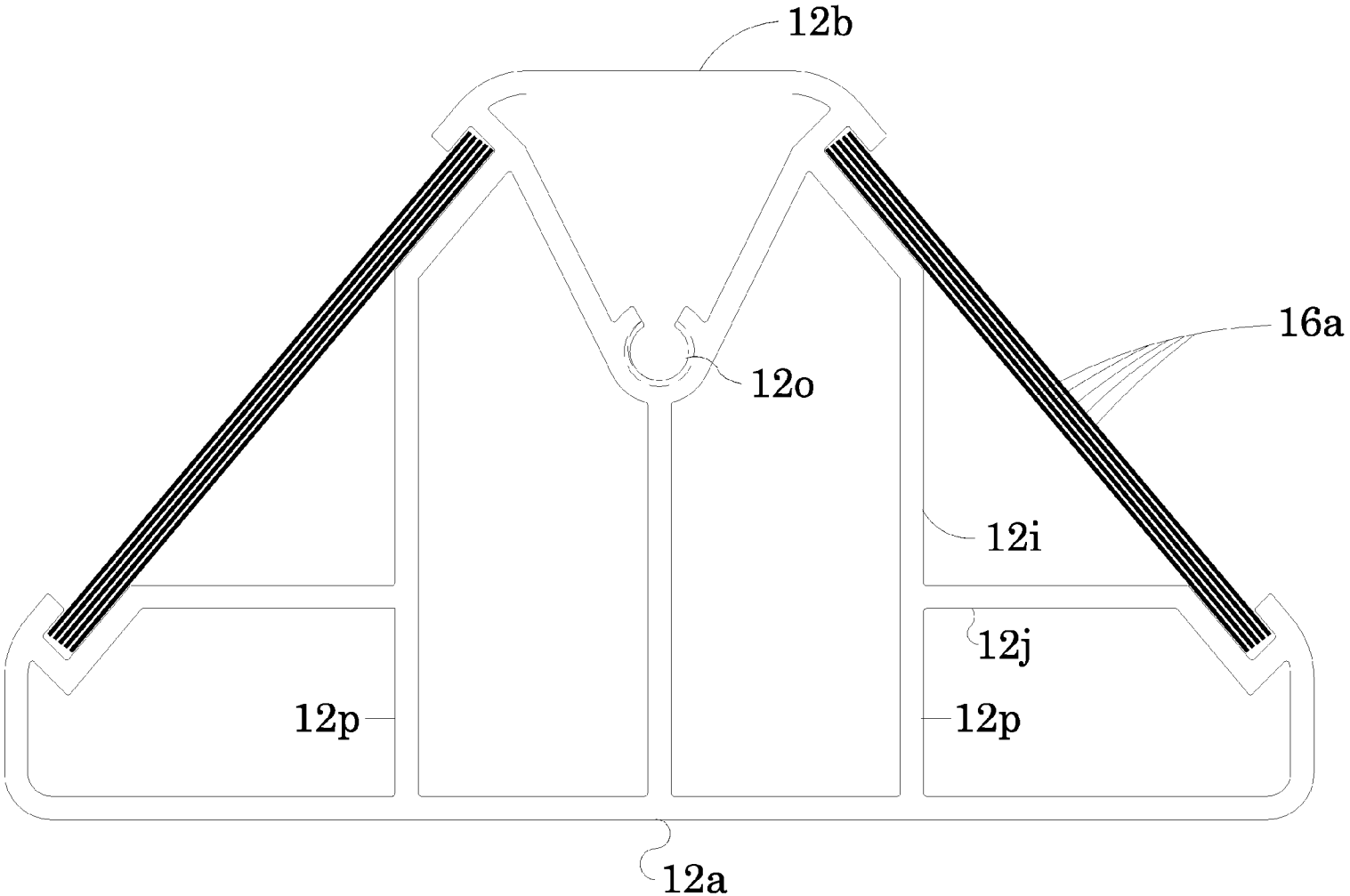
FIG. 3*b* is an end view of the invention of FIG. 1, further depicting multiple stacked advertisement sheets installed on both sides of the barrier.
Figure 4A:
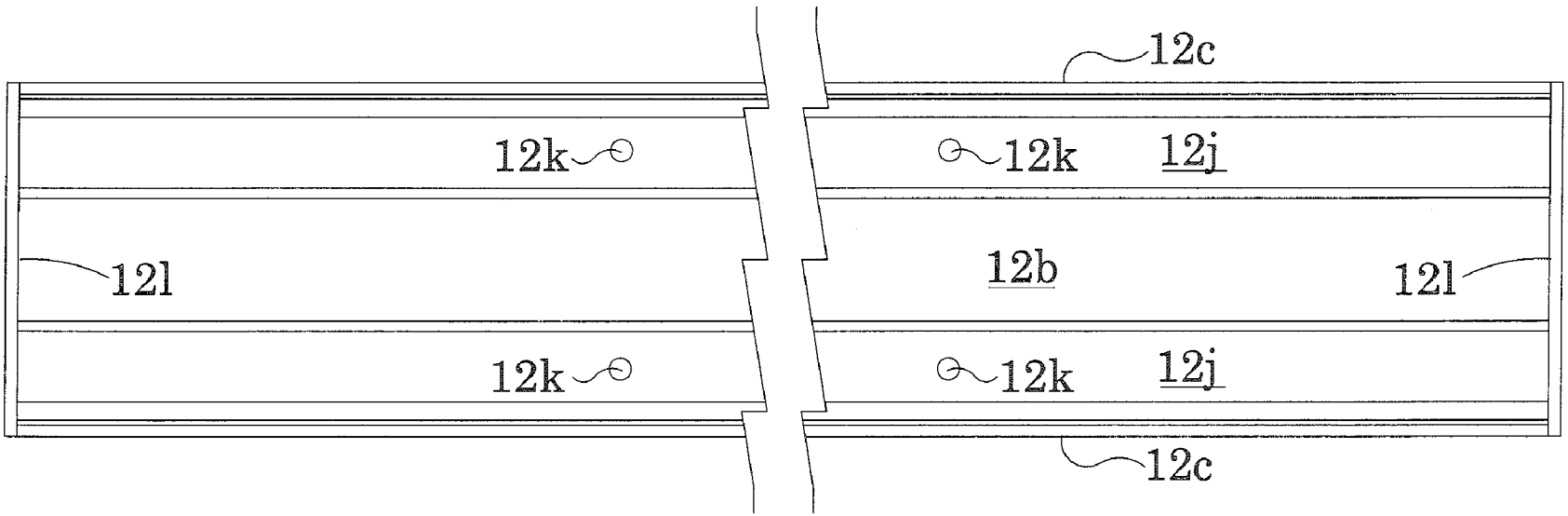
FIG. 4*a* is a plan view of the invention of FIG. 1 without the advertisement sheet installed.
Figure 4B:
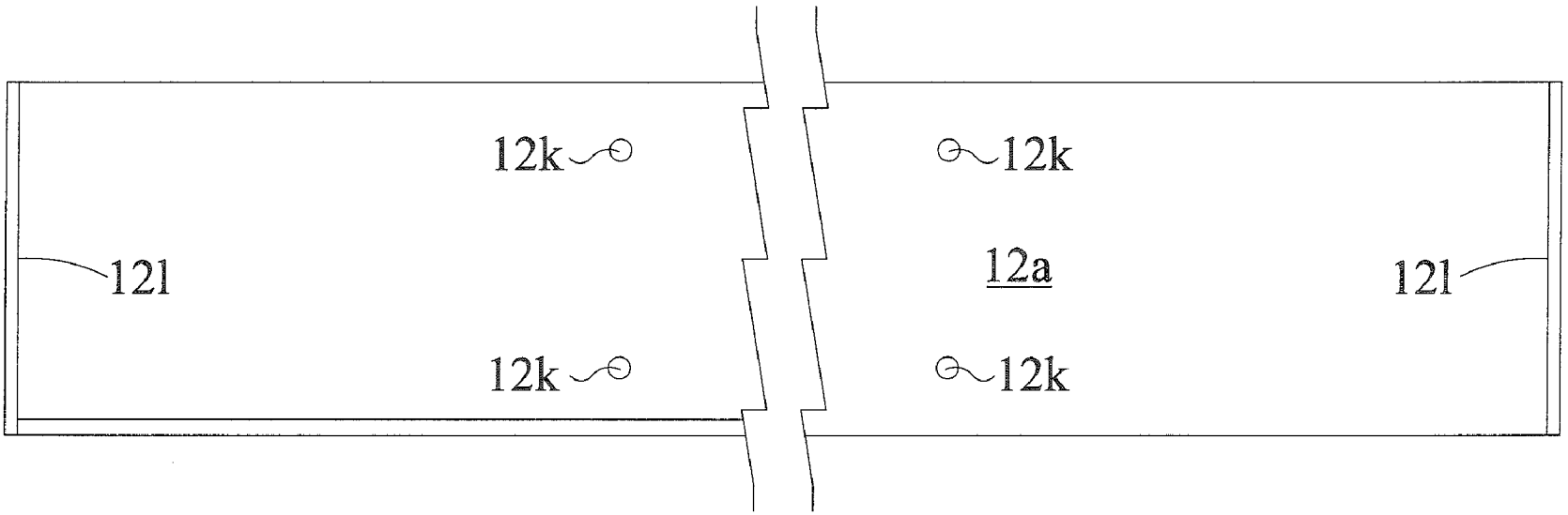
FIG. 4*b* is a bottom view of the invention of FIG. 1.
Figure 4C:
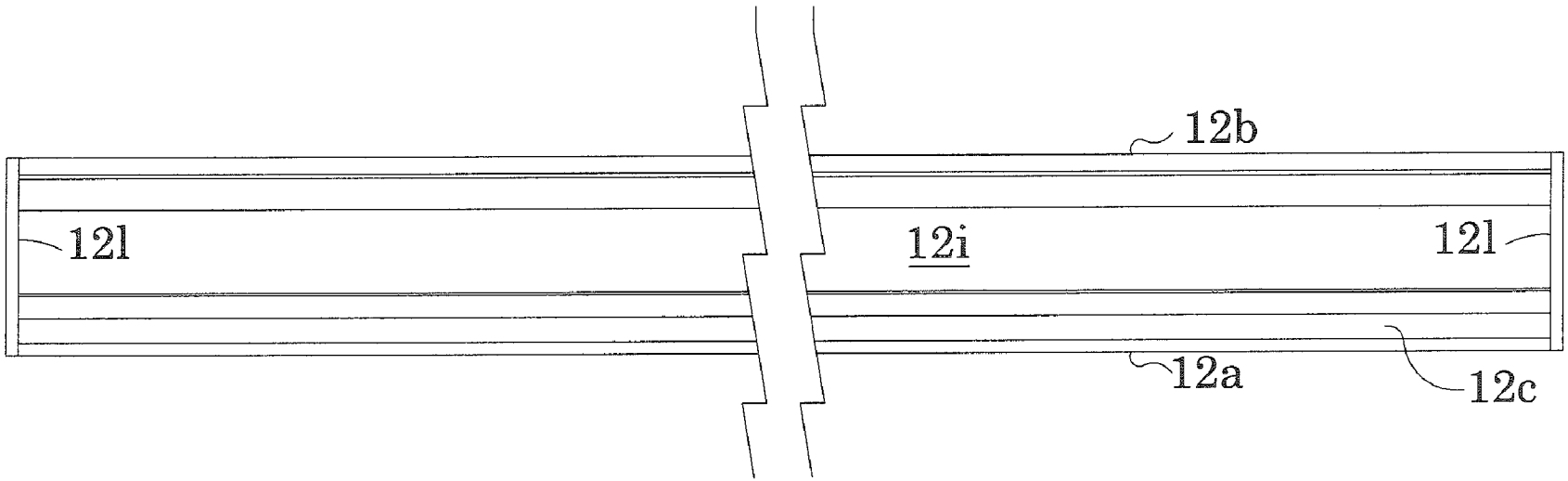
FIG. 4*c* is a side view of the invention of FIG. 1 without the advertisement sheet installed.
Figure 4E:
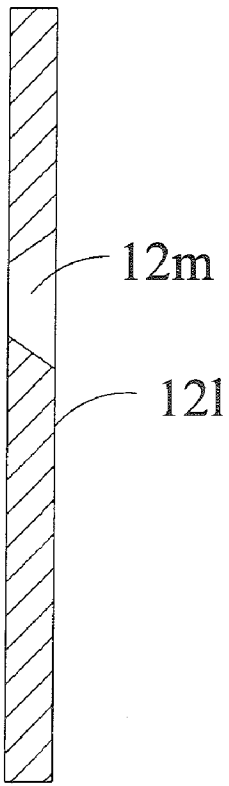
FIG. 4*e* is a cross-sectional view of the end cap of FIG. 4*d* depicted a tapered aperture for the head of the mechanical screw-type device used to engage the cap with the barrier main portion.
Figure 4D:
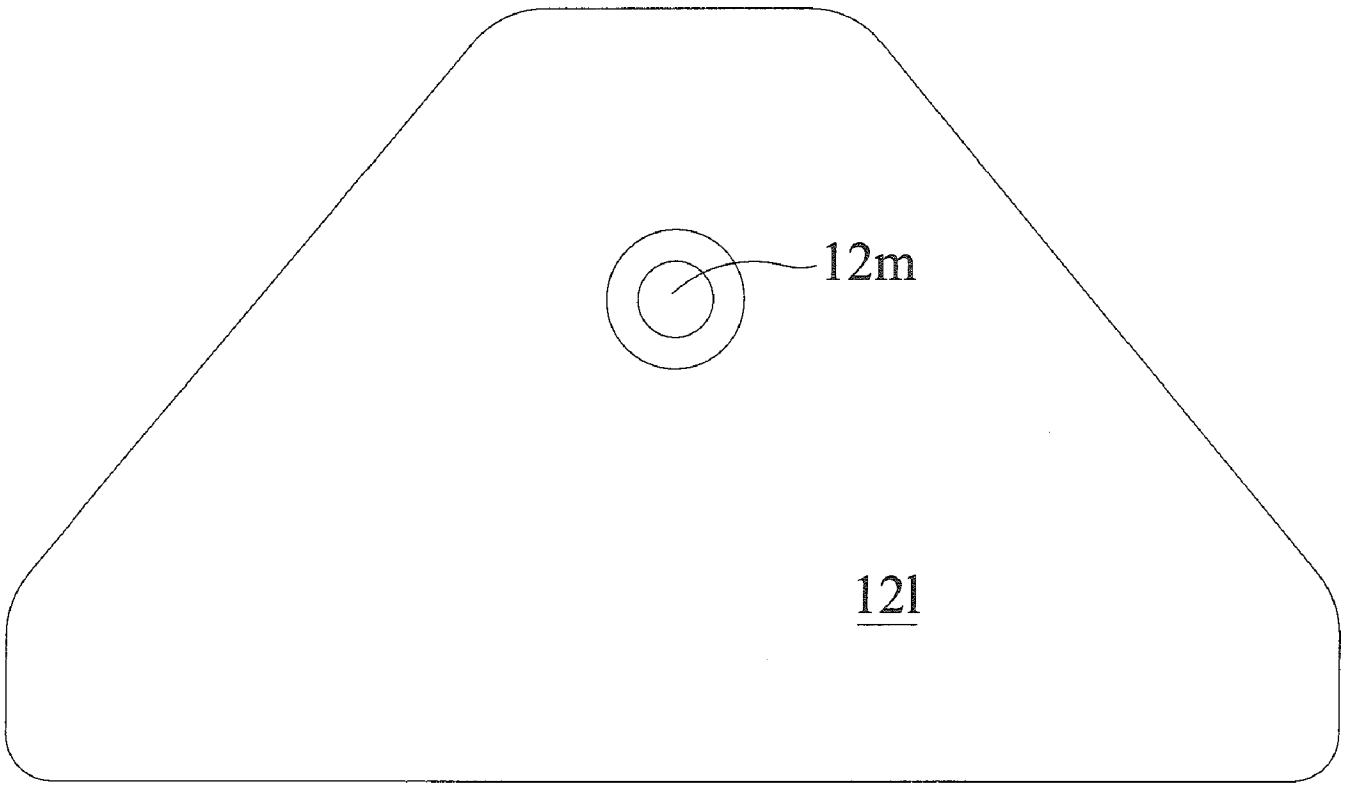
FIG. 4*d* is a representative end view of one of the end caps of the invention depicted in FIG. 1.
Figure 4F:
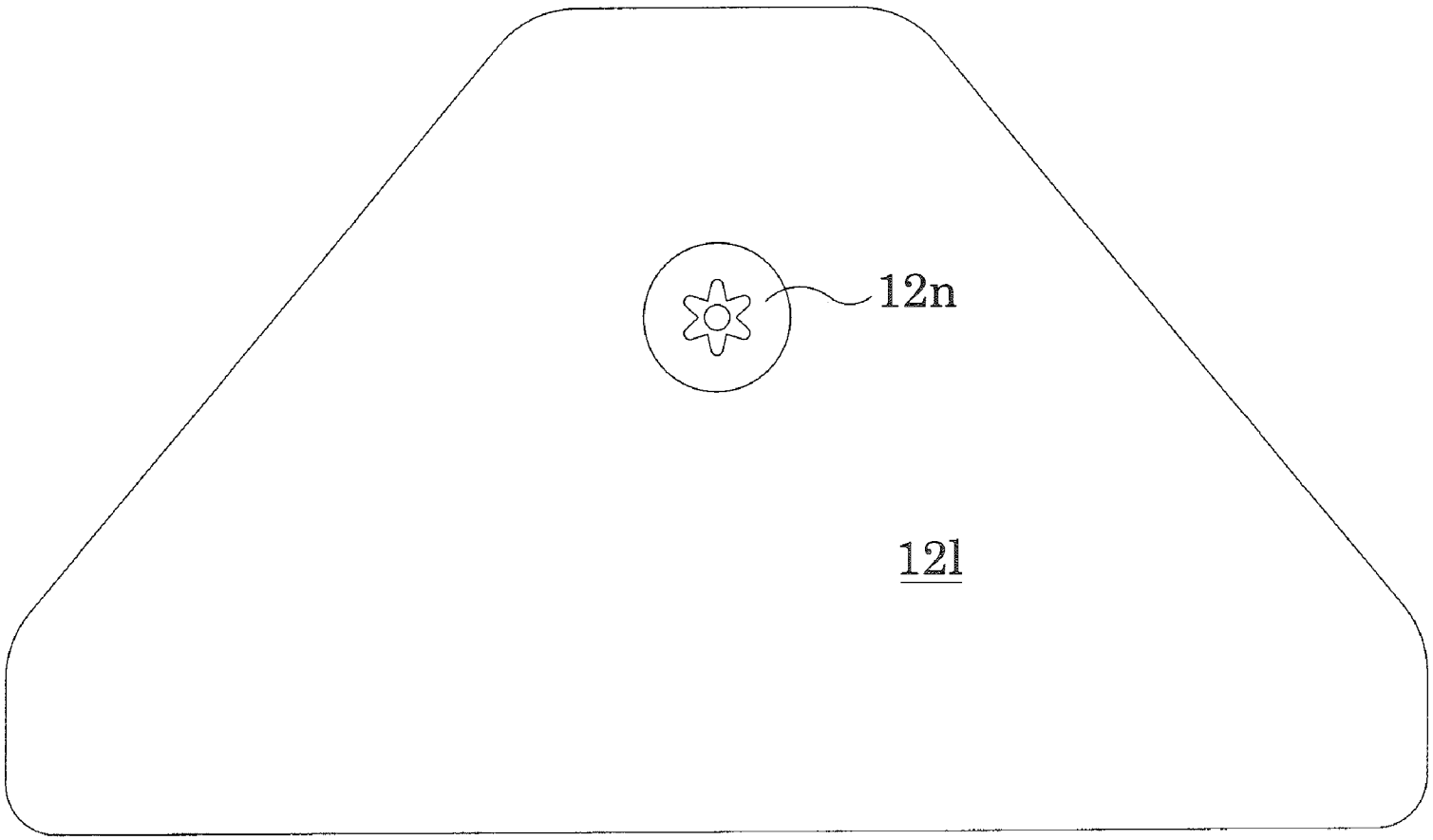
FIG. 4*f* is an end view of one of the end caps of the invention depicted in FIG. 1 with an example of a head of a screw-type device installed.
Figure 5:
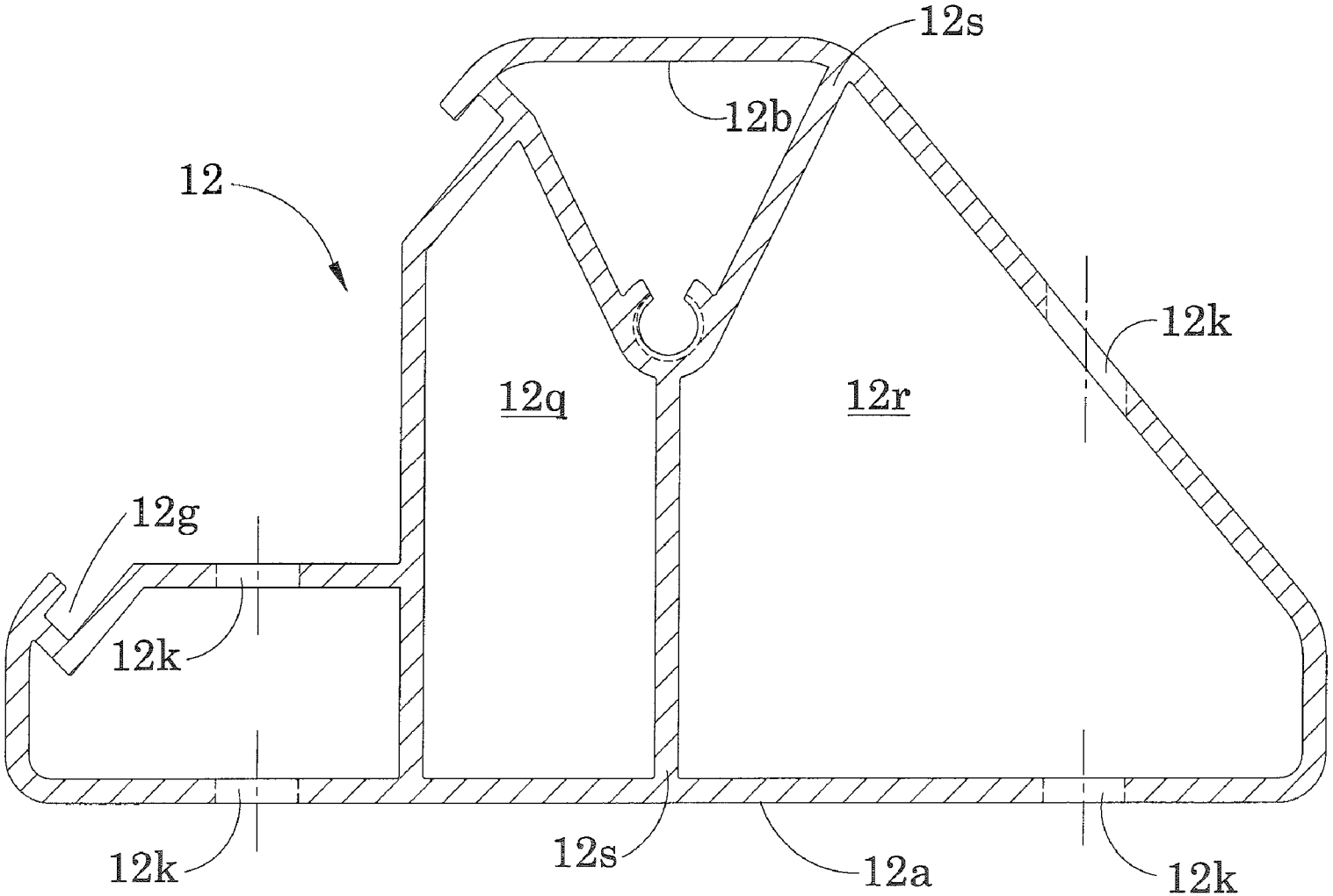
FIG. 5 is a cross-sectional view of a variant embodiment of the invention where the advertisement indicia is displayed on one side of the barrier.

With reference now to the drawings, and in particular to FIGS. 1*a*, 1*b*, 2, 3*a*, 3*b*, 4*a*-4*f* and 5-8 thereof, the preferred embodiment of the new and improved vehicle barrier/advertisement system embodying the principles and concepts of the present invention and generally designated by the reference numeral 10 will be described.

The present invention, the vehicle barrier/advertisement system 10 is comprised of a plurality of components. Such components in their broadest context include a barrier, a thin barrier cover and an advertisement sheet. Such components are individually configured and correlated with respect to each other so as to attain the desired objective.

Accordingly, the vehicle barrier advertisement system 10 comprises a vehicle barrier 12 comprising a generally horizontal planar lower face member 12*a* and a spaced-apart top portion 12*b* at a predetermined height $H_1$ from said horizontal planar lower face member 12*a;* at least one side of said vehicle barrier 12 further comprising: a vertical portion 12*c* extending from a distal end 12*d* of said horizontal planar lower face member 12*a* a predetermined height $H_2$, said top portion 12*b* having a width dimension less than that of said planar lower face such that a side of said top portion 12*b* is in an angularly aligned relationship $\alpha$ to a top of said vertical portion 12*c;* and a pair of opposed grooves 12*g* extending substantially along the length of the vehicle barrier side, one of said grooves being located near said vertical portion extended height 12*f* and the opposed groove being located near an edge 12*e* of said top portion, wherein said opposing grooves serve as means for receiving an advertisement indicia sheet 16*a*,20. A cavity 12*h* underlies the advertisement indicia sheet 16*a*,20. This cavity 12*h* is formed behind the sheet 16*a*,20 when the sheet 16*a*,20 is installed within the opposing grooves 12*g*.

Barrier 12 can be extruded so as to form an inwardly directed L-shaped portion forming the cavity 12*h* underlying said advertisement sheet indicia when said advertisement indicia sheet 16,20 is installed. The L-shaped portion extends a length of the vehicle barrier 12 side, where a vertical leg 12*i* of the L-shaped portion ends near the top portion 12*b* of the vehicle barrier and a horizontal leg 12*j* of the L-shaped portion commences near the top of the vertical portion 12*c*.

As far as the inside structure is concerned, the walls and angles of the walls are critical for the support necessary to bear the weight of a vehicle that would stop on the bumper.

The opposing grooves 12*g* are aligned so that when said advertisement indicia sheet 16*a*,20 is installed, the sheet is oriented at the angularly aligned relationship $\alpha$ so as to generally face upward for ease of reading the advertisement indicia on the sheet 16*a*,20.

The horizontal lower face member 12*a* further comprises a plurality of spaced-apart apertures 12*k*, where the spaced-apart apertures 12*k* are aligned with a corresponding plurality of spaced-apart apertures 12*k* in the horizontal leg 12*j* of said L-shaped portion, both of the plurality of spaced-apart apertures 12*k* serving as means for inserting desired fasteners to hold the system 10 in place when installed for use.

The barrier 12 includes a pair of end caps 12*l* at each end of the system. Included are means for securing the end caps 12*l* to the barrier 12 system. Although there are several known methods to secure the end caps 12*l* such as a snap-like coupling joint, a preferred mechanical means is shown by example only in the drawings, where a fastener in the form of a screw-type fastener 12*n* is inserted through an aperture 12*m* in the cap 12*l* and is threadedly engaged with a corresponding fastener mating portion in the form of a screw thread 12*o* at each end of the barrier 12.

When making the extruded barrier 12, it is preferable to include a structural support member 12*p* extending from near a bottom of the vertical leg 12*i* of the L-shaped portion downwardly to the horizontal planar lower face member 12*a*.

The barrier 12 typically has a height $H_1$ of about 4 inches and a length of about 36 inches (91.4 cm) to about 84 inches (213.4 cm).

The barrier 12 can be made from a durable material comprising one of the one of the following types of material 6063T5 aluminum alloy material, 6061T6 aluminum alloy material, polycarbonate material, acrylonitrile butadiene styrene (ABS) material, polypropylene material, acetal material or nylon material.

The end caps can be made from a durable material comprising one of the following types of material 5052T5 aluminum alloy material, 6061T6 aluminum alloy material, 7073T6 aluminum alloy material, steel material, iron material, polycarbonate material, acrylonitrile butadiene styrene (ABS) material, polypropylene material, acetal material or nylon material.

The pair of opposed grooves 12*g* can be sized so as to receive one of two or more advertisement indicia sheets 16*a*,20 or one advertisement indicia sheet with an underlying spacer sheet 16*b*.

The advertisement indicia sheet 16*a*,20 can be made from material comprising one of the following types of material: metal material, plastic material, film material or paper material. The advertisement indicia sheet 16*a*,20 typically has a thickness of from about 0.005 inches (0.012 cm) thick to about 0.188 inches (0.476 cm) thick. The material may be flexible so that it can be partially flexed to manipulate within the grooves 12*g*, yet sufficiently stiff so as not to collapse within the cavity 12*g* area.

Figure 6:
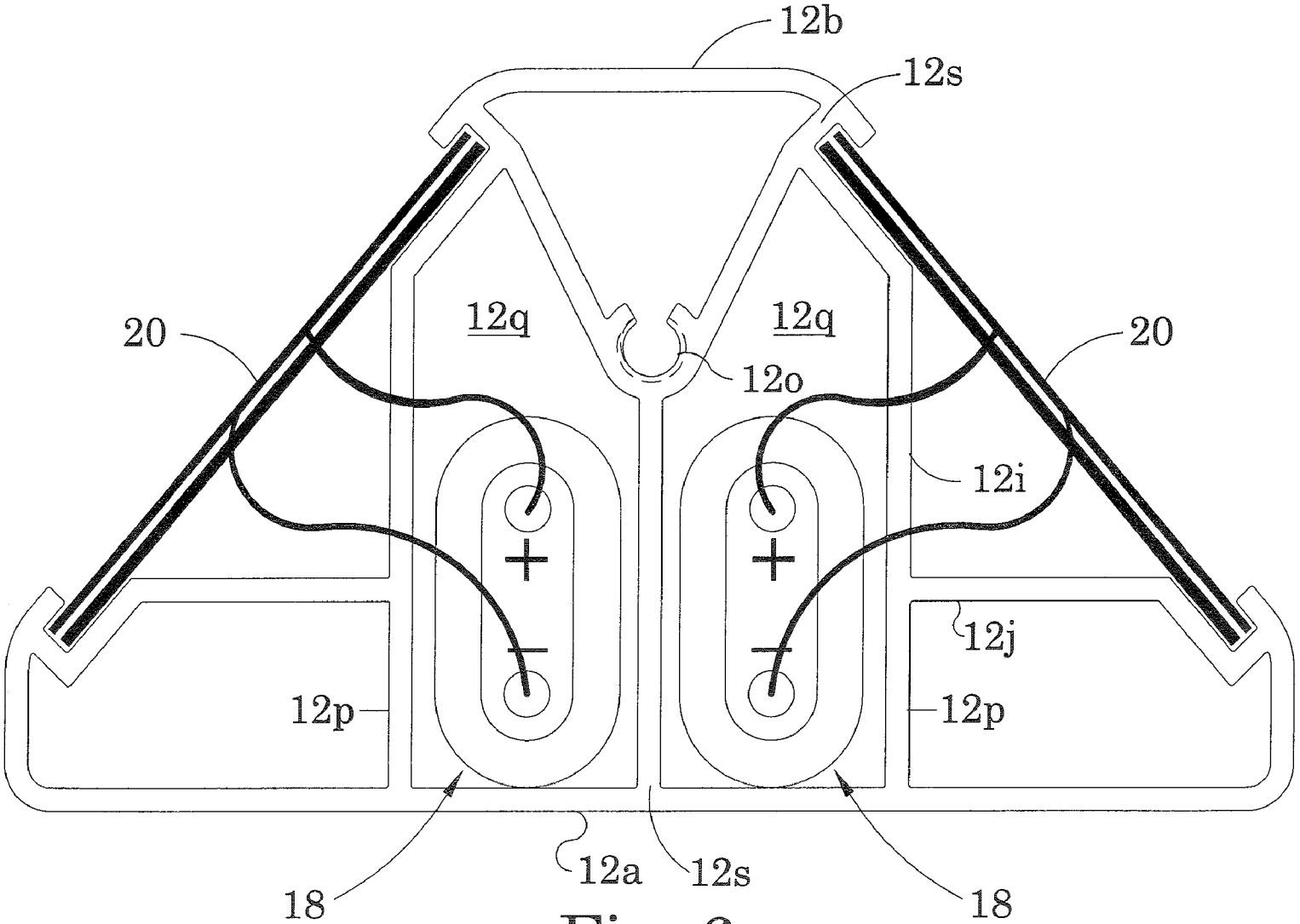
FIG. 6 is a cross-sectional view similar to FIG. 3*a* further depicting conceptually the addition of a power pack as an example only for illuminating the advertisement sheet.
Figure 7:
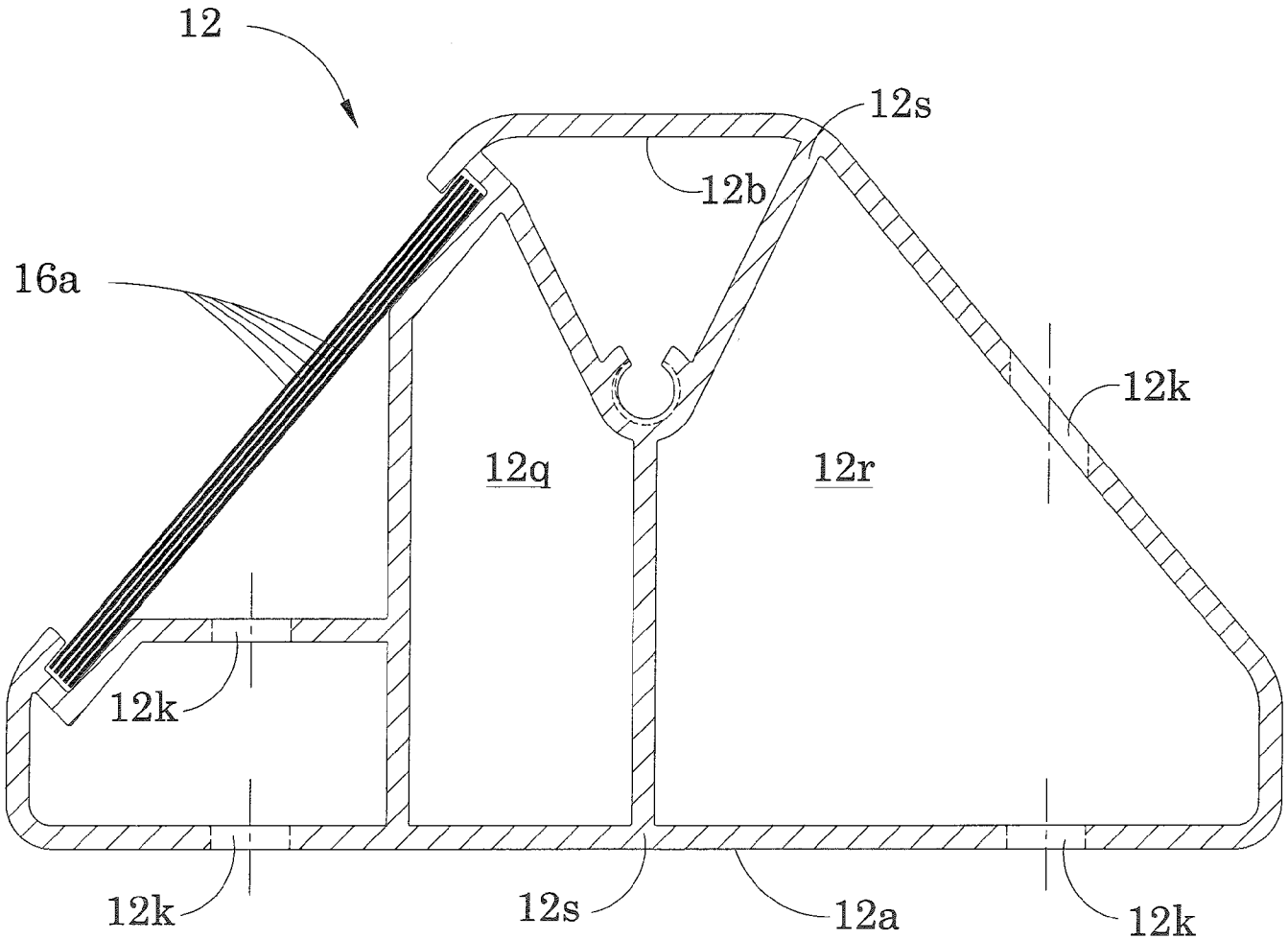
FIG. 7 is a cross-sectional view of an embodiment similar to FIG. 5 with the addition of multiple advertisement sheets on one side.
Figure 8:
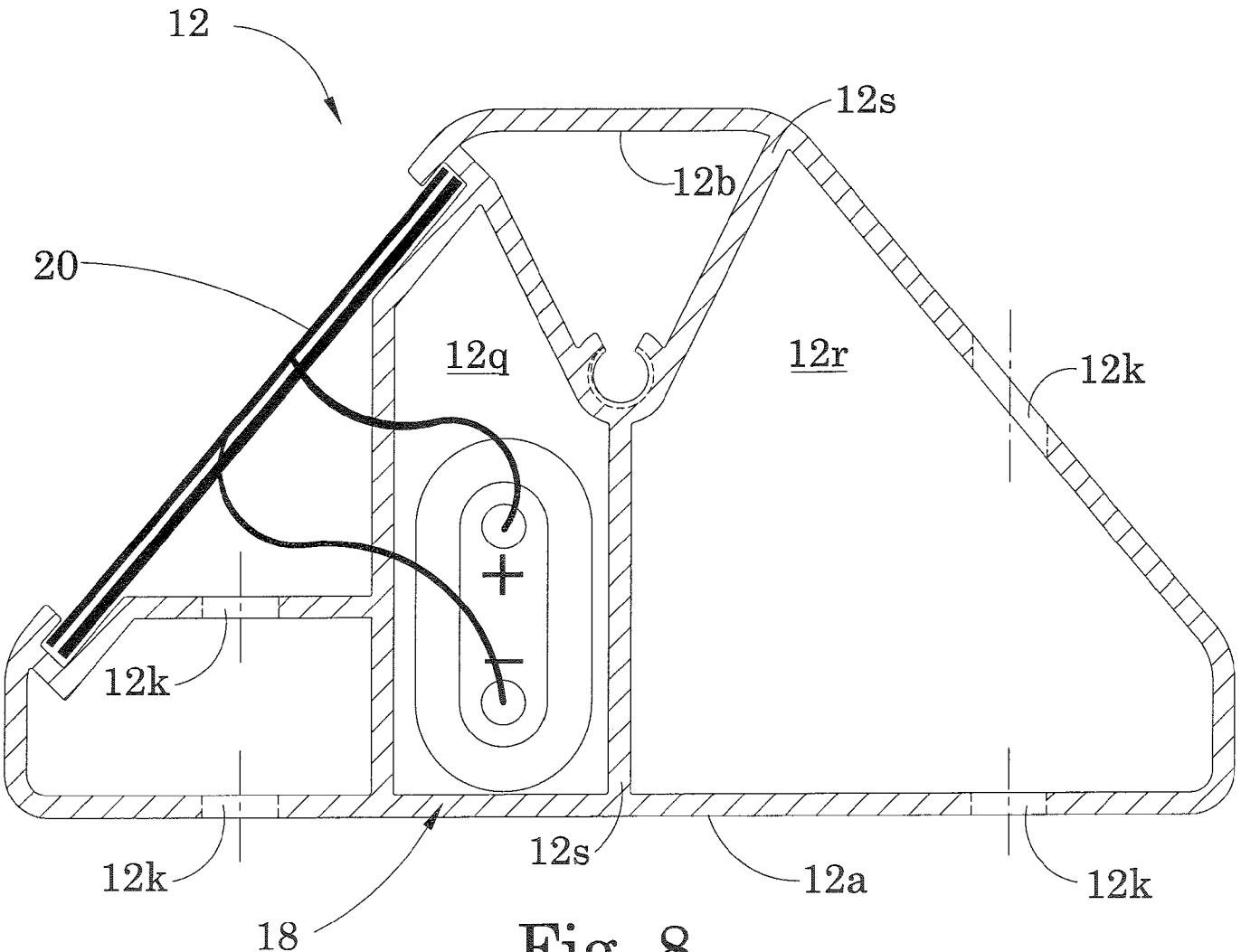
FIG. 8 is a cross-sectional view of an embodiment similar to FIG. 7, except one advertisement sheet and a spacer is included on the one side and a power pack is depicted as an example of means to illuminate the advertisement sheet.

As depicted by way of example only in FIGS. 6 and 8, the system 10 can further be adapted to provide for means for illuminating the advertisement indicia sheet 16*a*,20 and/or said advertisement indicia presented on said sheet. As shown in this example, a battery pack 18 provides for power to illuminate the advertisement sheet 20.

For illuminated advertisement sheets 20, the main sources of illumination and/or animation is preferably at this time, the use of Electroluminescence (EL) technology. This technology produces light through luminescence instead of incandescence and requires a low amount of energy and does not produce significant heat. It is also contemplated as within the scope of this invention that as new technologies develop, such lighting technology would, if appropriate, be incorporated in a wheel stop system as herein presented. FIGS. 6 and 8 are a conceptual depictions only where the power is wired from the batteries 18 to the advertisement sheet 20, which would be adapted to include the EL technology. As further depicted in FIGS. 2, 3*a*, 3*b* and/or 5-8, the inwardly directed L-shaped portion 12*i*,12*j* forming a triangular-shaped cavity 12*h* underlies the advertisement sheet indicia sheet 16*a*,20 when the advertisement indicia sheet 16,20 is installed. The vertical leg 12*i* of the L-shaped portion further extends downwardly to the horizontal planar lower face member 12*a* (see extended structural support truss member 12*p*). In addition, a main support truss member 12*s* extends vertically from proximately a mid-line of the horizontal planar lower face member 12*a* to the spaced-apart top portion 12*b* with adjacent first (12*q*) and second (12*q*, 12*r*) cavities being formed on respective sides of the main support truss member 12*s*. Note that the truss member 12*s* extends at the upper end as a generally Y-shaped central truss member. Cavities 12*q*,12*r* are available for storage of spare ad sheets, replacement ad sheets, spare batteries, operating batteries or other desired items.

Examples of EL would be Light Emitting Diodes (LED's) and EL "Paper" which is coated with a phosphor material. The LED's will be used in edge light applications and will be limited to illuminate the advertisement. With the EL Paper, we can not only effectively illuminate the advertisement but animate it as well. This can be accomplished through printed phosphor circuit(s) and a circuit controller that would supply electricity to each circuit in a predetermined order which in turn creates the animation. To get a better understanding of available commercial technology in this illumination field, one source of such products are those made by W & Co. Design Solutions, Ltd., Seven Oaks Kent, United Kingdom. Both of these forms of lighting are very durable and energy efficient and have the best immediate potential. Additionally, other methods of lighting the "Advertisement" have been researched such as "neon." However, considering the environment and use of the product, it is believed that the LED and EL types of lighting are the preferred alternatives at this time.

The DC power battery pack 18 voltage can vary depending on the desired advertisement animation or illumination area. The exact voltage required for each advertisement is determined when the illumination areas are determined. The animation amounts can also determine power usage. Basically each advertisement will have a different power requirement. As mentioned above, Electro-Luminescent advertisements are films printed with a phosphor substance similar to circuit boards in the electronic industry. The circuit can be printed in shapes to be used in animation of printed in "flood coats" to illuminate entire surfaces. After the phosphor is printed, the advertisement, which is printed on a different film, is laminated over the phosphor coated film. One current is applied, either AC or DC via transformers, to the advertisement lights. With animated advertisements, a controller would be used between the advertisement and power source to distribute the current according to the animated program. Additionally, possible sources of lighting the advertisement are edge lighting with acrylic and LED's, backlighting with various sources of lighting such as LED's, fluorescents, neon and incandescent. You may also use reflective printing processes to make the advertisement appear to be lit when headlights hit the advertisement.

As to the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed is:

1. A vehicle barrier advertisement system comprising:

a vehicle barrier comprising a generally horizontal planar lower face member and a spaced-apart top portion at a predetermined height from said horizontal planar lower face member;

at least one side of said vehicle barrier further comprising:

a vertical portion extending from a distal end of said horizontal planar lower face member a predetermined height, said top portion having a width dimension less than that of said planar lower face such that a side of said top portion is in an angularly aligned relationship to a top of said vertical portion;

a pair of opposed grooves extending substantially along the length of the vehicle barrier side, one of said grooves being located near said vertical portion extended height and the opposed groove being located near an edge of said top portion, wherein said pair of opposed grooves are sized so as to receive one of two or more advertisement indicia sheets or one advertisement indicia sheet with an underlying spacer sheet;

an inwardly directed L-shaped portion forming a triangular-shaped cavity underlying said advertisement sheet indicia sheet when said advertisement indicia sheet is installed, said L-shaped portion extending a length of said vehicle barrier side, wherein a vertical leg of the L-shaped portion ends near said top portion of the vehicle barrier and a horizontal leg of the L-shaped portion commences near said top of the vertical portion and said vertical leg of said L-shaped portion further extending downwardly to said horizontal planar lower face member;

a main support truss member extending vertically from proximately a mid-line of said horizontal planar lower face member to said spaced-apart top portion with adjacent first and second cavities being formed on respective sides of said main support truss member; and means for illuminating said advertisement indicia sheet and/or said advertisement indicia presented on said sheet.

2. The system according to claim 1, wherein the opposing grooves are aligned so that when said advertisement indicia sheet in installed, the sheet is oriented at said angularly aligned relationship so as to generally face upward for ease of reading said advertisement indicia on said sheet.

3. The system according to claim 1, wherein said horizontal lower face member further comprises a plurality of spaced-apart apertures, said spaced-apart apertures being aligned with a corresponding plurality of spaced-apart apertures in said horizontal leg of said L-shaped portion, both of said plurality of spaced-apart apertures serving as means for inserting desired fasteners to hold the system in place when installed for use.

4. The system according to claim 1, further comprising a pair of end caps at each end of said system.

5. The system according to claim 4, further comprising means for securing said end caps to said system.

6. The system according to claim 5, wherein said means for securing said end caps to said system comprises an aperture in each of said end caps through which a fastener is inserted for mechanical engagement with a corresponding fastener mating portion near each end of said system.

7. The system according to claim 1, wherein the barrier has a height of about 4 inches and a length of about 36 inches (91.4 cm) to about 84 inches (213.4 cm).

8. The system according to claim 1, wherein the system is made from a durable material comprising one of 6063T5 aluminum alloy material, 6061T6 aluminum alloy material, polycarbonate material, acrylonitrile butadiene styrene (ABS) material, polypropylene material, acetal material or nylon material.

9. The system according to claim 4, wherein said end caps are made from a durable material comprising one of 5052T5 aluminum alloy material, 6061T6 aluminum alloy material, 7073T6 aluminum alloy material, steel material, iron material, polycarbonate material, acrylonitrile butadiene styrene (ABS) material, polypropylene material, acetal material or nylon material.

10. The system according to claim 1, wherein said advertisement indicia sheet is made from material comprising one of metal material, plastic material, film material or paper material.

11. The system according to claim 1, wherein the advertisement indicia sheet has a thickness of from about 0.005 inches (0.012 cm) thick to about 0.188 inches (0.476 cm) thick.

12. The system according to claim 1, wherein the means for illuminating said advertisement indicia sheet and/or said advertisement indicia presented on said sheet utilizes battery powered LED technology, battery powered neon lighting technology or EL technology incorporated with said advertisement indicia sheet.

* * * * *